United States Patent [19]

Goldfarb et al.

[11] Patent Number: 4,509,760

[45] Date of Patent: Apr. 9, 1985

[54] TARGET STRUCTURE

[75] Inventors: Adolph E. Goldfarb, 1432 SE. Wind Cir., Westlake Village, Calif. 91361; Delmar K. Everitt, Woodland Hills, Calif.

[73] Assignee: Adolph E. Goldfarb, Westlake Village, Calif.

[21] Appl. No.: 493,520

[22] Filed: May 11, 1983

[51] Int. Cl.[3] ..... A63F 9/02

[52] U.S. Cl. ..... 273/380; 124/26; 124/36; 124/38; 273/384; 273/393; 273/405

[58] Field of Search ..... 273/355, 356, 380, 405, 273/384, 393; 124/16, 17, 26, 29, 35 R, 36, 37, 38

[56] References Cited

U.S. PATENT DOCUMENTS

| | | | |
|---|---|---|---|
| 284,965 | 9/1883 | Ireland | 124/37 X |
| 649,201 | 5/1900 | Ewing | 124/38 X |
| 2,385,724 | 9/1945 | Olson | 273/380 |
| 2,558,257 | 6/1951 | Koepnick | 273/380 |
| 3,207,515 | 9/1965 | Mireider | 124/36 X |
| 3,398,956 | 8/1968 | Lukes | 273/355 |
| 3,794,325 | 2/1974 | Stender | 124/36 X |

*Primary Examiner*—Anton O. Oechsle

*Attorney, Agent, or Firm*—Romney, Golant, Martin & Ashen

[57] ABSTRACT

A target structure comprising of at least one target and means coupled to the target for exploding the target when the target is hit by an object. In a particular embodiment, the target is a horizontal panel and projector means is located beneath the panel and projects the panel away from the target structure when the panel is struck by an object. The projector means is spring-loaded and is triggered by the force of the object striking the panel.

11 Claims, 8 Drawing Figures

FIG. 4
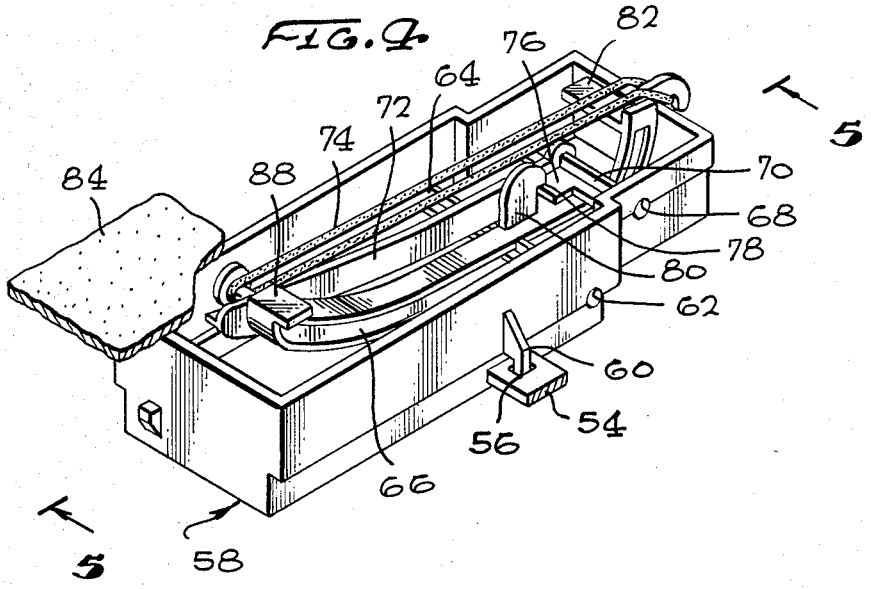
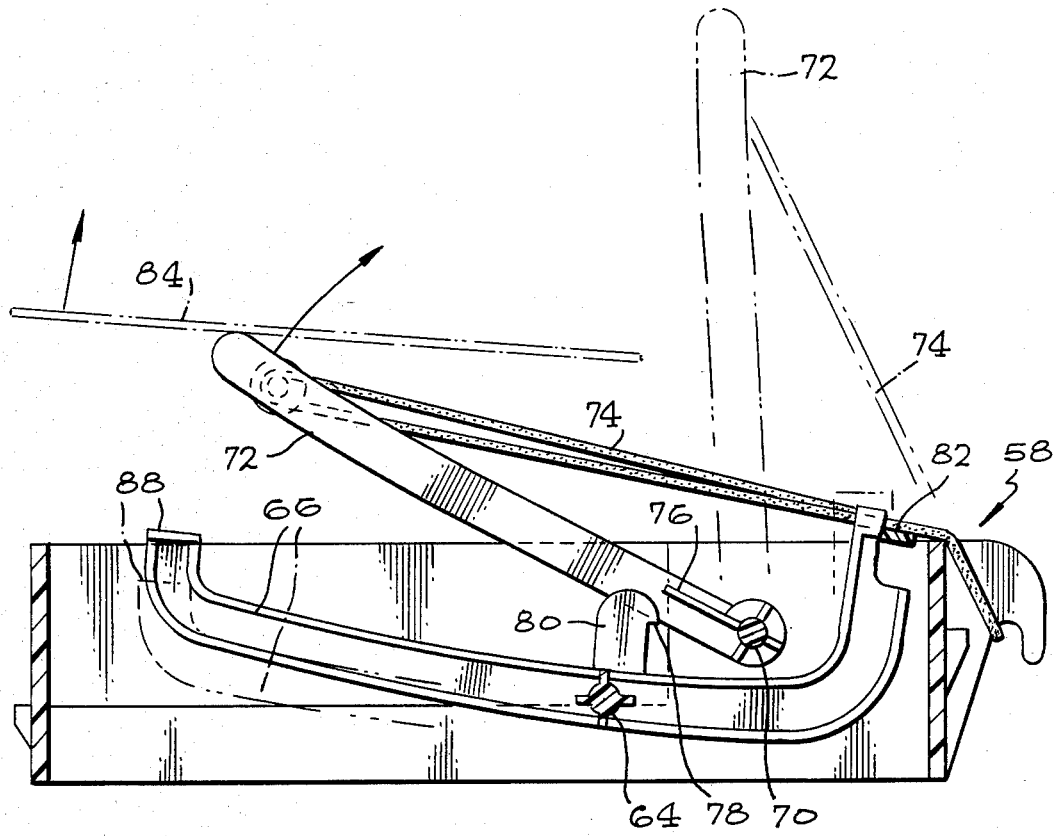
FIG. 5

FIG. 6
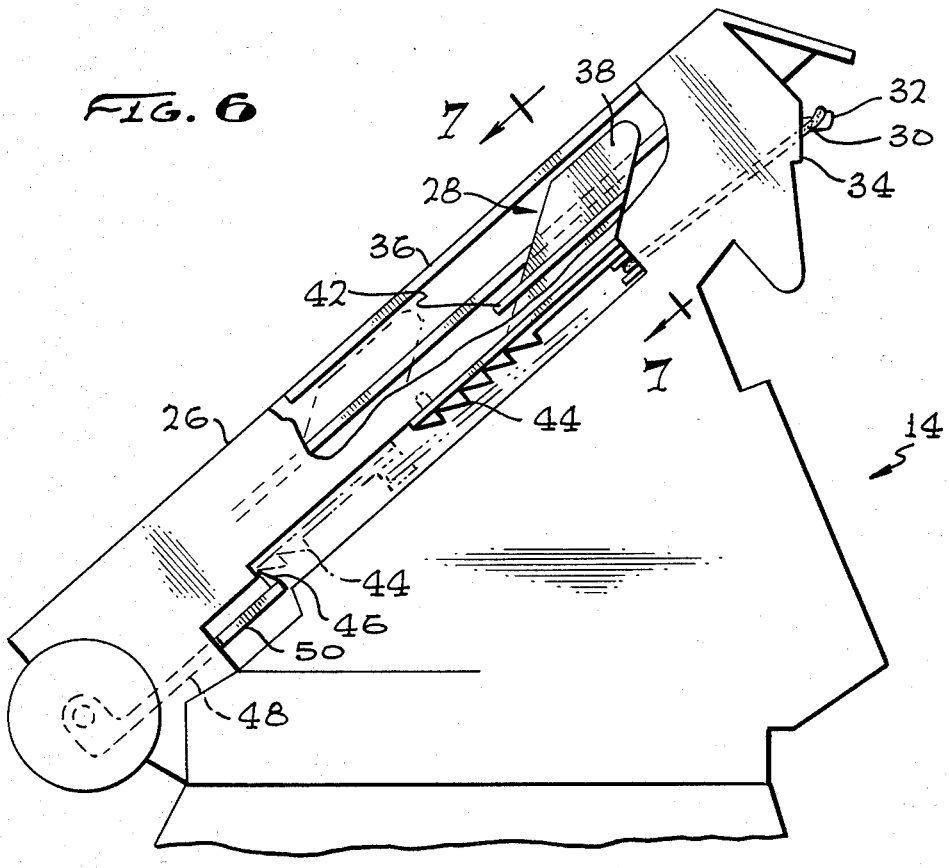
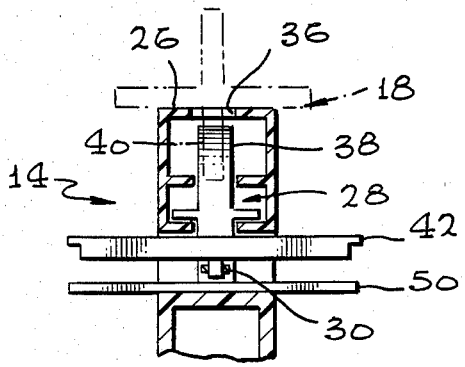
FIG. 7
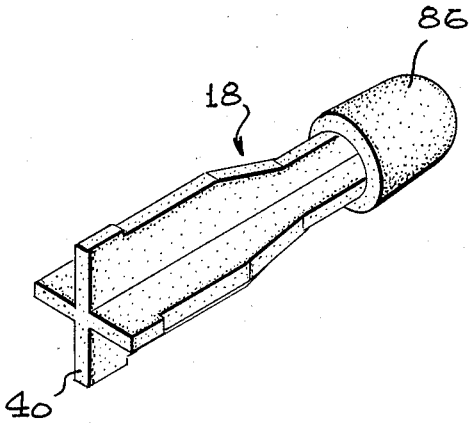
FIG. 8

TARGET STRUCTURE

TECHNICAL FIELD

The invention relates to the field of toy battle games and, in particular, to a target structure which explodes upon impact.

BACKGROUND ART

Toy battle games have engaged the attention of children for countless centuries. In many of these games objects are thrown at the opponent's forces to disrupt and destroy them. In these games the targets are generally structures which are vertically positioned and toppled upon impact with the thrown object. This requires that the structures be widely spaced from one another in order to have individual, rather than multiple, hits caused by the thrown object. In addition, since the incoming object, such as a missile, explodes upon impact, a distinct element of realism is missing in a game in which the targets are merely toppled upon impact without any accompanying explosion.

Accordingly, it is a general object of the present invention to provide an improved target structure for use with toy games.

It is another object of the present invention to provide an improved target structure having a target which explodes upon impact.

It is a further object of the present invention to provide an improved target structure which can be placed close to a like target structure and not be affected by an adjacent hit.

It is still another object of the present invention to provide a horizontal target structure for use with toy games.

DISCLOSURE OF INVENTION

A target structure for use with toy battle games is provided. The target structure comprises at least one target and means coupled to the target for exploding the target when the target is hit by an object. In a particular embodiment, the target is a horizontal panel and projector means is located beneath the panel and projects the panel away from the target structure when the panel is struck by an object. The projector means is spring-loaded and is triggered by the force of the object striking the panel.

The novel features which are believed to be characteristic of the invention, both as to its organization and its method of operation, together with further objects and advantages thereof, will be better understood from the following description in connection with the accompanying drawings in which a presently preferred embodiment of the invention is illustrated by way of example. It is to be expressly understood, however, that the drawings are for purposes of illustration and description only and are not intended as a definition of the limits of the invention.

BRIEF DESCRIPTION OF THE DRAWINGS

FIG. 4 illustrates the projector means used in the target structure shown in FIG. 3.

FIG. 5 is a cross-sectional view of the projector means taken along line 5—5 of FIG. 4.

FIG. 6 illustrates in greater detail the launcher of FIG. 2.

FIG. 7 is a cross-sectional view of the projector means taken along line 7—7 of FIG. 6.

FIG. 8 is an isometric view of a missile used with the launcher of FIG. 2.

BEST MODE FOR CARRYING OUT THE INVENTION

Figures 1, 2:
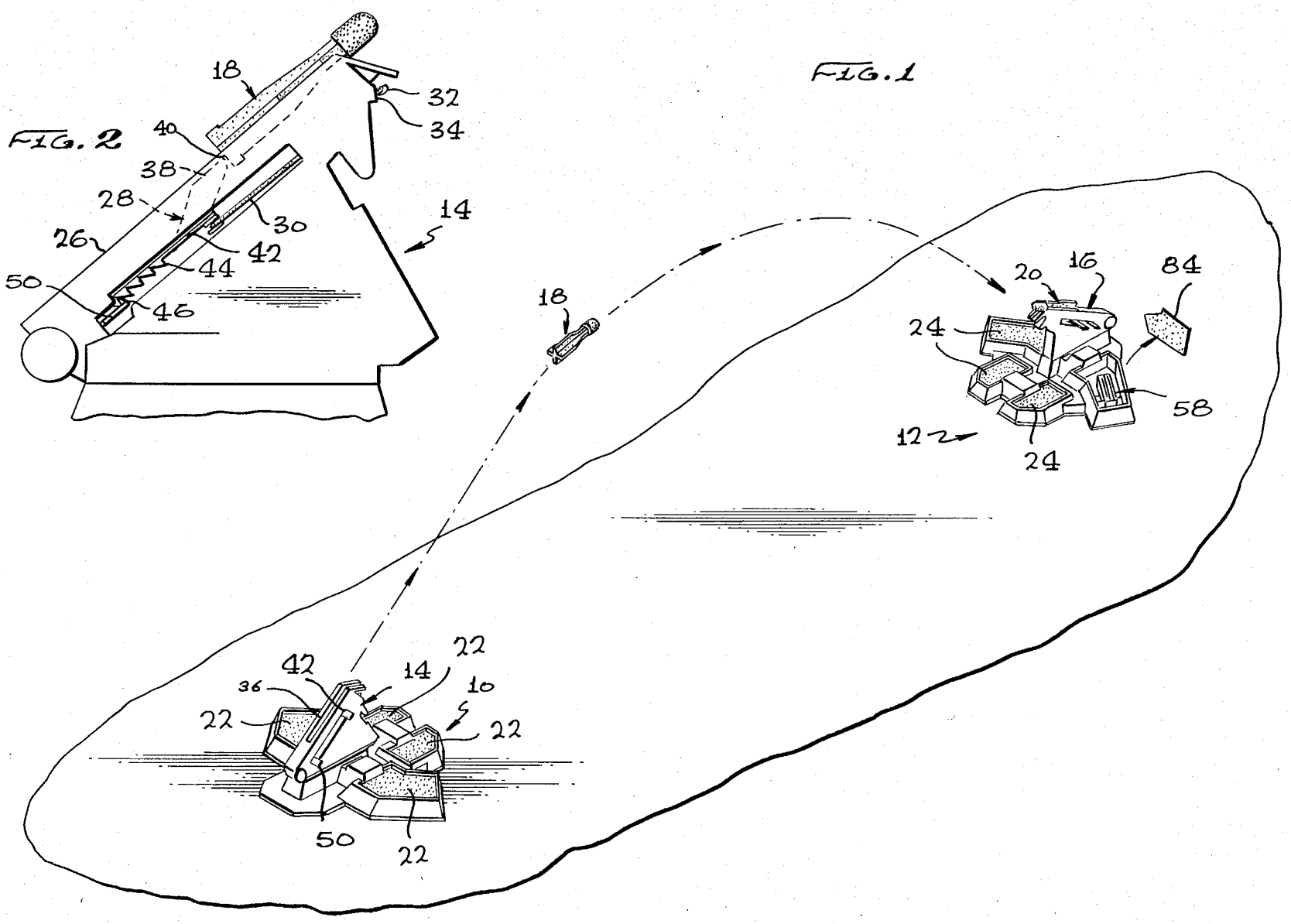
FIG. 1 is an isometric view of a battle game utilizing the target structure of the present invention.
FIG. 2 illustrates in greater detail the launcher used in the battle game shown in FIG. 1.

Referring now to FIG. 1, an isometric view of a battle game utilizing the target structure of the present invention is illustrated. Battle stations 10, 12 are positioned facing one another and spaced a selected distance apart. The battle stations 10, 12 have launchers 14, 16 positioned thereon and adapted to launch missiles 18, 20 at one another. The battle stations 10, 12 also have target structures 22, 24 thereon which are designed to explode upon being struck by the missiles 18, 20.

In play, the missiles 18, 20 are placed on the launchers 14, 16. As is illustrated in FIGS. 2 and 6, the angle of the ramp 26 of the launcher 14 is fixed at approximately 40° so as to obtain a fairly high and long trajectory so that the missile 18 will come down upon the surface of the target structures 22, 24. The length of the trajectory is determined by adjusting the tension of the launcher mechanism. Slide 28 is coupled by rubber band 30 to protuberance 32 on the upper front edge 34 of the launcher 14. As shown in FIGS. 6–8, the slide 28 is restrained to move in track 36 and comprises element 38 which engages fin 40 of missile 18, projections 42 by which the slide 28 is pulled back against the rubber band 30 and teeth 44 which engage member 46 on element 48. In operation, the slide 28 is retracted against the rubber band 30 until the teeth 44 engage member 46. The distance the missile 18 is launched then depends upon which of the teeth 44 is finally engaged by member 46, the greatest distance being obtained by slide 28 being drawn as far along the track 36 as possible. When projections 50 on element 48 are depressed, member 46 disengages from the teeth 44 and the slide 28 is quickly pulled by the rubber band 30 to launch the missile 18.

Figure 3:
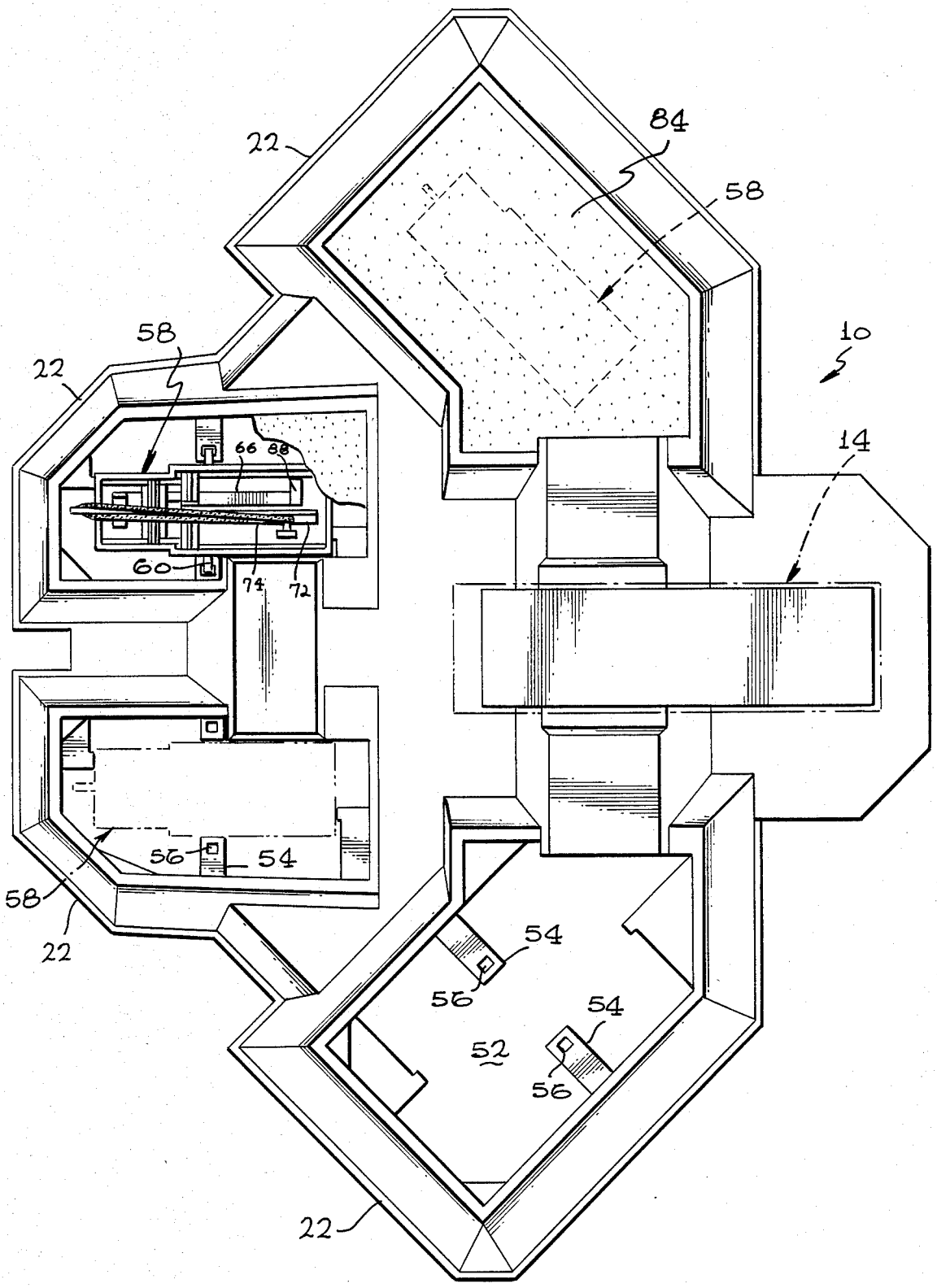
FIG. 3 illustrates in greater detail the target structure of the present invention.

As was stated previously, the target structures 22, 24 are designed to explode upon being hit by the missiles 18, 20. Referring now to FIGS. 3–5, the battle station 10 includes a plurality of target structures 22. The target structures 22 are illustrated in various stages of construction for purposes of clarity. Each target structure 22 consists of an opening 52 having a plurality of tabs 54 with apertures 56 to receive case 58. Case 58 has lugs 60 which engage with aperatures 56 when case 58 is set into opening 52 in battle station 10. Case 58 has holes 62 which engage tabs 64 on release arm 66 and holes 68 which engage tabs 70 on projector arm 72. Rubber band 74 is coupled to the case 58 and to projector arm 72.

In operation, projector arm 72 is pressed down into the case 58 until lip 76 on projector arm 72 engages notch 78 carried by tab 80 of release arm 66. The rubber band 74 also engages and depresses the surface of tab 82 on release arm 66 to cause lip 76 to engage notch 78. A target panel 84 is then placed over case 58. When the target panel 84 is struck by the tip 86 of the missile 18, the target panel 84 is driven down against surface 88 on release arm 66 causing release arm 66 to pivot, disengage notch 78 from lip 76 and release projector arm 72 from engagement. Rubber band 74 then causes projector arm 72 to quickly pivot and, as shown in FIGS. 1 and 5, explosively hurl the target panel 84 up and away from the battle station 10, indicating a hit.

An improved target structure has thus been described which has a target which explodes when the target is hit by an object and which is hurled away from the target structure by projector means. With this description in mind, it is obvious that numerous modifications and departures may be made by those skilled in the art. For example, the launcher described could obviously be replaced by any suitable type of spring actuated launcher. In addition, the projector means could consist of any one of a number of impact triggerable mechanisms. Thus the invention is to be construed as being limited only by the spirit and scope of the appended claims.

INDUSTRIAL APPLICABILITY

The target structure is useful to provide realism in toy battle games.

We claim:

1. A battle simulating game apparatus for two or more players to play a competitive missile shooting game, the apparatus comprising at least two relatively movable combination launcher-target units, one unit for each player, each unit comprising:

(a) a separate base for allowing a player to selectively locate the unit in desired positions on a supporting surface such as a floor or table, said base having an upper surface;

(b) A missile launcher on and movable with said base for propelling missiles toward another unit; and (c) means on and movable with said base providing a plurality of targets, said target means comprising:

a plurality of relatively large, upwardly facing, separate target panels, said target panels collectively occupying a substantial portion of said upper surface of said base, propelling means for propelling said target panels away from said unit, and release means for releasing an individual target panel, to allow it to be propelled when that panel is struck by a missile to simulate an explosive hitting the target while leaving said other target panels on the unit in condition to be propelled only when they are subsequently struck by a missile, so that the players can continue to shoot missiles back and forth even after one or more targets have been hit.

2. The target structure of claim 1 wherein said means for propelling each said target panel is a spring-loaded projector coupled to said target panel and triggerable upon impact by said missile.

3. The target structure of claim 2 wherein said spring-loaded projector comprises:

a pivotable projector arm having engagement means thereon;

a movable release arm adapted to releasably engage said engagement means; and spring means coupled to said projector arm and said release arm to cause said release arm to engage said engagement means when said projector arm is pivoted from a first position to a second position and to cause said projector arm to pivot from said second position to said first position when said release arm is moved to cause said release arm to release said engagement means, said release arm being moved by the impact of said object to release said engagement means and allow said projector arm to explode said target by pivoting from said second position to said first position.

4. The target structure of claim 3 wherein said target panel is projected away from said target structure by said projector arm pivoting from said second position to said first position.

5. The target structure of claim 4 wherein said panel is positioned to transmit the impact of said missile on said panel to said release arm.

6. The target structure of claim 2 wherein said spring-loaded projector comprises:

a projector arm adapted to pivot around a first selected point and having engagement means thereon;

spring means coupled to said projector arm to cause said projector arm to pivot; and a release arm adapted to pivot around a second selected point and to releasably engage said engagement means, said spring means causing said release arm to engage said engagement means, said release arm being pivoted by the impact of said object to release said engagement means and allow said projector arm to pivot and cause said target to explode.

7. The target structure of claim 6 wherein said target panel is projected away from said target structure by said projector arm pivoting around said first selected point.

8. The target structure of claim 7 wherein said panel is positioned to transmit the impact of said missile on said panel to said release arm.

9. The battle game of claim 1 wherein said missile launcher includes an inclined ramp adapted to hold a missile and spring-loaded propulsion means to propel such missile up said ramp.

10. The battle game of claim 9 wherein said ramp is set at a fixed angle and said propulsion means is adapted to be adjustable in tension to vary the length of the trajectory of such missile.

11. The battle game of claim 10 wherein said propulsion means has a plurality of teeth and said missile launcher further includes means to releasably engage said teeth, said tension being adjusted by engaging a particular one of said teeth.

* * * * *